US005316249A

United States Patent [19]

Anderson

[11] Patent Number: 5,316,249

[45] Date of Patent: May 31, 1994

[54] STAND WITH TETHER FOR ELECTRONIC REMOTE CONTROL UNITS

[76] Inventor: Alfred Anderson, 2453 Garapan, Houston, Tex. 77091

[21] Appl. No.: 934,277

[22] Filed: Aug. 25, 1992

[51] Int. Cl.[5] ..... A47F 7/00

[52] U.S. Cl. ..... 248/146; 211/13; 248/205.2; 248/206.3

[58] Field of Search ..... 248/146, 205.2, 206.3, 248/493, 174, 551, 552; 211/13

[56] References Cited

U.S. PATENT DOCUMENTS

| | | | |
|---|---|---|---|
| 1,905,069 | 4/1933 | Stair | 248/206.3 |
| 3,557,322 | 1/1971 | Walden | 379/455 X |
| 4,712,693 | 12/1987 | Striplin | 211/13 X |
| 4,733,840 | 3/1988 | D'Amore | 248/551 X |
| 4,991,892 | 2/1991 | Burrel | 248/205.2 X |
| 5,009,379 | 4/1991 | Sadler | 248/174 |
| 5,127,615 | 7/1992 | Jones | 248/205.2 X |
| 5,192,042 | 3/1993 | Wotring et al. | 248/205.2 X |

*Primary Examiner*—Richard K. Seidel
*Assistant Examiner*—Kenneth E. Peterson
*Attorney, Agent, or Firm*—Kenneth A. Roddy

[57] ABSTRACT

A stand for holding an electronic remote control unit has a horizontal bottom surface, a contiguous vertical end surface extending upwardly from one end of the bottom surface, and a contiguous rectangular top surface extending outwardly from the upper end of the vertical surface spaced directly above the horizontal bottom surface for releasably supporting an electronic remote control unit thereon. An extendible coiled tether cord is secured at one end to the stand and its free end is connected to the remote control unit whereby the remote control unit may be removed from a position supported on the stand but is prevented from complete separation from the stand. Fabric hook and loop fasteners are provided on the free end of the tether and top surface of the stand. In a preferred embodiment, the stand is provided with suction cups to anchor the stand on the flat surface which facilitate disengagement of the hook and loop fasteners and allows the remote control unit to be easily removed from the stand with one hand. Since the remote control unit is tethered to the stand it cannot be completely separated therefrom and will not become lost or misplaced, and because the stand can be anchored by suction cups, the likelihood of the entire stand being removed from the location in which the remote control unit is used is reduced.

6 Claims, 2 Drawing Sheets

STAND WITH TETHER FOR ELECTRONIC REMOTE CONTROL UNITS

BACKGROUND OF THE INVENTION

1. Field of the Invention

This invention relates generally to apparatus for use with electronic entertainment devices, and more particularly to a support stand for electronic remote control units which includes a tether for preventing the remote control unit from being completely separated from the stand.

2. Brief Description of the Prior Art

Modern electronic entertainment devices, such as TV's VCR's, CD players, etc., are often provided with a hand-held electronic remote control unit for actuating the entertainment device from a location distant from the device. The electronic remote control unit is provided as a convenience to be used in place of, or in addition to, the panel controls on the entertainment device. Recently, "universal" remote control units have been developed which allows one to control several different entertainment devices with only one single "universal" remote control unit.

Many households have several such entertainment devices with a remote control unit for each, thus there are usually several remote control units, all having a similar appearance, and it is difficult to quickly determine which is the correct one to use for the particular appliance to be activated. Often the entertainment devices are located in various rooms in the dwelling.

Since hand-held remote control units are designed to be portable, as small as possible, and separable from the entertainment device which they control, they often become lost or misplaced. Many hours are spent trying to locate a misplaced remote control unit.

It would therefore be desirable to provide a stand for holding the electronic remote control unit which has a tether connecting the remote control unit to the stand such that it can be used but not completely separated from the stand.

There are several patents which disclose various holders and stands for holding electronic remote control units, most of which will not prevent the remote control unit from being carried off, misplaced, or lost. Thus, if the user does not replace the remote control unit, it can still become lost or misplaced. These patents utilize hook and loop fasteners, but do not provide a means for securing the holder or stand to the surface on which it rests, thus to disengage the fasteners the user must grasp the holder or stand with one hand and remove the remote control unit with the other hand, or lift the stand with the remote control unit attached and aim it at the electronic entertainment device.

VonKleist et al, U.S. Pat. No. 4,991,817 discloses a wedge-shaped caddy for remote control units which has horizontal bottom surface, opposed vertical side surfaces, and an inclined top surface. The top surface ha a layer of high friction material such as either felt or one half of a hook and loop fastener. A mating strip of the hook and loop material is applied to various remote control devices used with the caddy. The four surfaces of the wedge-shaped caddy forms a compartment between the inclined and horizontal surfaces for storing television program guides and the like. This device has no provision for securing the caddy to a flat surface or for maintaining the remote control unit and the caddy together, and when removed from the caddy, the remote control unit can still be lost or misplaced.

Wells et al, U.S. Pat. No. 4,852,746 discloses a box-like orientation and storage apparatus for multiple remote control units which has four intersecting perpendicular walls defining a rectangular central compartment with open cells with short walls on each side of the compartment. Strips of a hook and loop fastener are disposed on the bottom surface of the open cells and the mating hook and loop element is applied to various remote control units to be stored in the open cells. The height of the walls are slightly greater than the thickness of the remote control units received in the cells such that any of the four sides of the apparatus can be placed face down on a flat surface. This device also has no provision for securing the apparatus to a flat surface or for maintaining the remote control unit and the storage apparatus together, and when removed from the apparatus, the remote control units can still be lost or misplaced.

Lowe, U.S. Pat. No. 4,838,505 discloses a vertical holder for multiple remote control units having a base with a plurality of upstanding walls which define a central storage compartment. Strips of a hook and loop fastener are disposed on the surface of the walls and the mating hook and loop element is applied to various remote control units to be releasably attached to the walls. The device allows the user to operate a single remote control unit while it and the remote control units are attached to the device. This device also has no provision for maintaining the remote control units and the holder together, and when removed from the apparatus, the remote control units can still be lost or misplaced.

The present invention is distinguished over the prior art in general, and these patents in particular by a stand for holding an electronic remote control unit which has a horizontal bottom surface, a contiguous vertical end surface extending upwardly from one end of the horizontal bottom surface, and a contiguous rectangular top surface extending outwardly from the upper end of the vertical surface spaced directly above the horizontal bottom surface for releasably supporting an electronic remote control unit thereon. An extendible coiled tether cord is secured at one end to the stand and its free end is connected to the electronic remote control unit whereby the remote control unit may be removed from a position supported on the stand but is prevented from complete separation from the stand. Fabric hook and loop fasteners are provided on the top surface and on the free end of the tether. In a preferred embodiment, suction cup members are provided on the bottom surface for releasably attaching the stand to a flat surface. The suction cups anchor the stand to the flat surface, making it easier to disengage the mating hook and loop fasteners and allow the remote control unit to be easily removed from the stand with one hand. Since the remote control unit is tethered to the stand, it cannot be completely separated therefrom and will not become lost or misplaced, and because the stand is anchored by the suction cups near the location of the electronic entertainment device, it also reduces the likelihood of the entire stand being removed from the location in which the remote control unit was intended to be used.

SUMMARY OF THE INVENTION

It is therefore an object of the present invention to provide a stand for holding an electronic remote control unit.

It is another object of this invention to provide a stand for holding an electronic remote control unit which has a tether connected between the stand and the remote control unit which allows the remote control unit to be removed from a position supported on the stand but prevents complete separation from the stand so that it will not become lost or misplaced.

Another object of this invention is to provide a stand for holding an electronic remote control unit which has fabric hook and loop fasteners between the support surface and the remote control unit and suction cup members on the bottom surface for releasably attaching the stand to a flat surface and making it easier to disengage the mating hook and loop fasteners and allows the remote control unit to be easily removed from the stand with one hand.

Another object of this invention is to provide a stand for holding an electronic remote control unit which is anchored by suction cups at a location near the electronic entertainment device controlled by the remote control unit to reduce the likelihood of the entire stand being removed from the location in which the remote control unit was intended to be used.

A further object of this invention is to provide a stand for holding an electronic remote control unit which is simple in design and attractive in appearance.

A still further object of this invention is to provide a stand for holding an electronic remote control unit which is simple in construction and economical to manufacture.

Other objects of the invention will become apparent from time to time throughout the specification and claims as hereinafter related.

The above noted objects and other objects of the invention are accomplished by a stand for holding an electronic remote control unit which has a horizontal bottom surface, a contiguous vertical end surface extending upwardly from one end of the horizontal bottom surface, and a contiguous rectangular top surface extending outwardly from the upper end of the vertical surface spaced directly above the horizontal bottom surface for releasably supporting an electronic remote control unit thereon. An extendible coiled tether cord is secured at one end to the stand and its free end is connected to the electronic remote control unit whereby the remote control unit may be removed from a position supported on the stand but is prevented from complete separation from the stand. Fabric hook and loop fasteners are provided on the top surface and on the free end of the tether. In a preferred embodiment, suction cup members are provided on the bottom surface for releasably attaching the stand to a flat surface. The suction cups anchor the stand to the flat surface, making it easier to disengage the mating hook and loop fasteners and allow the remote control unit to be easily removed from the stand with one hand. Since the remote control unit is tethered to the stand, it cannot be completely separated therefrom and will not become lost or misplaced, and because the stand is anchored by the suction cups near the location of the electronic entertainment device, it also reduces the likelihood of the entire stand being removed from the location in which the remote control unit was intended to be used.

DESCRIPTION OF THE PREFERRED EMBODIMENT

Figure 2:
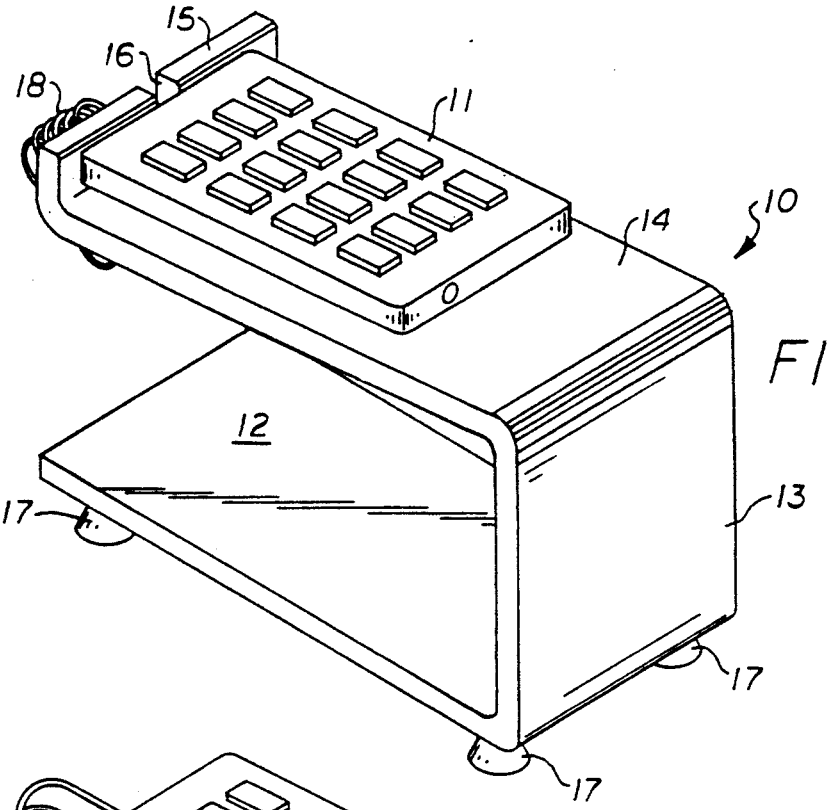
FIG. 2 is an isometric view of the support stand with tether for electronic remote control units, showing the remote control unit attached to the stand.
Figure 1:
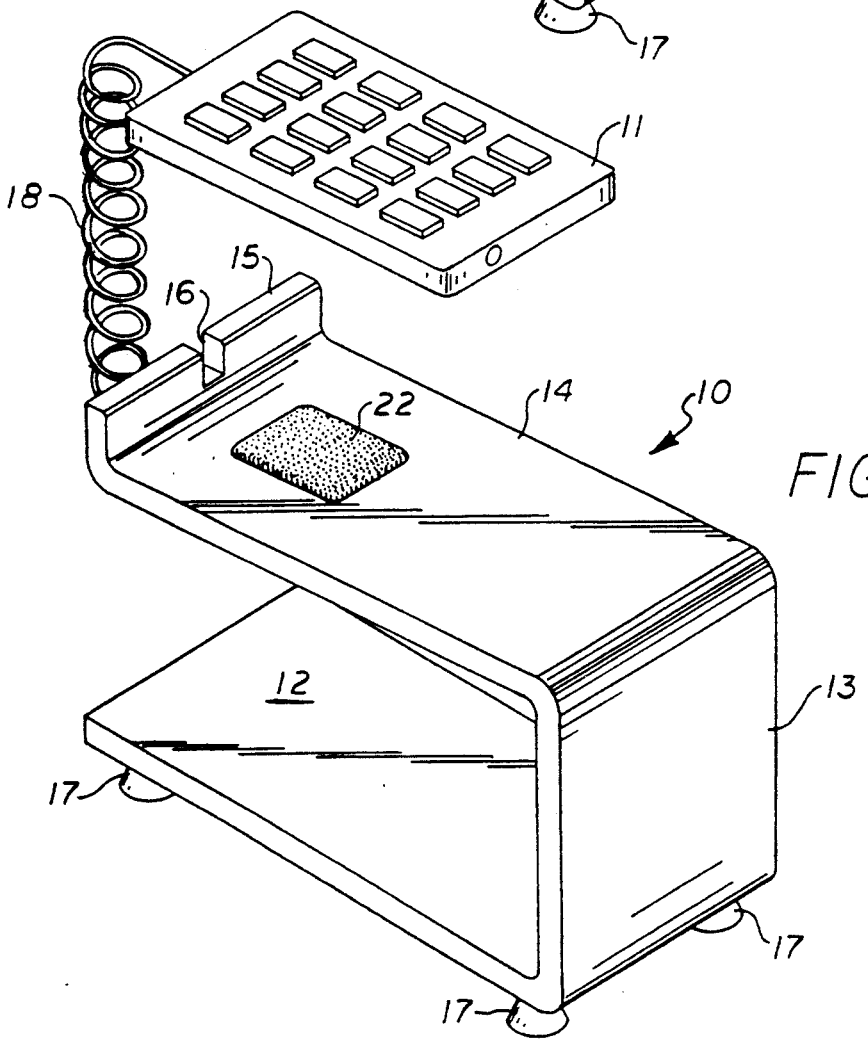
FIG. 1 is an isometric view of a support stand with tether for electronic remote control units in accordance with the present invention, showing a remote control unit removed from the stand but still tethered thereto.
Figure 4:
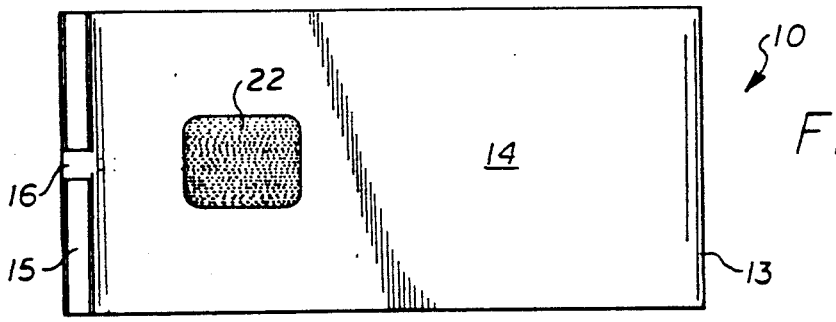
FIG. 4 is a top plan view of the support stand with the remote control unit not shown.
Figure 3:
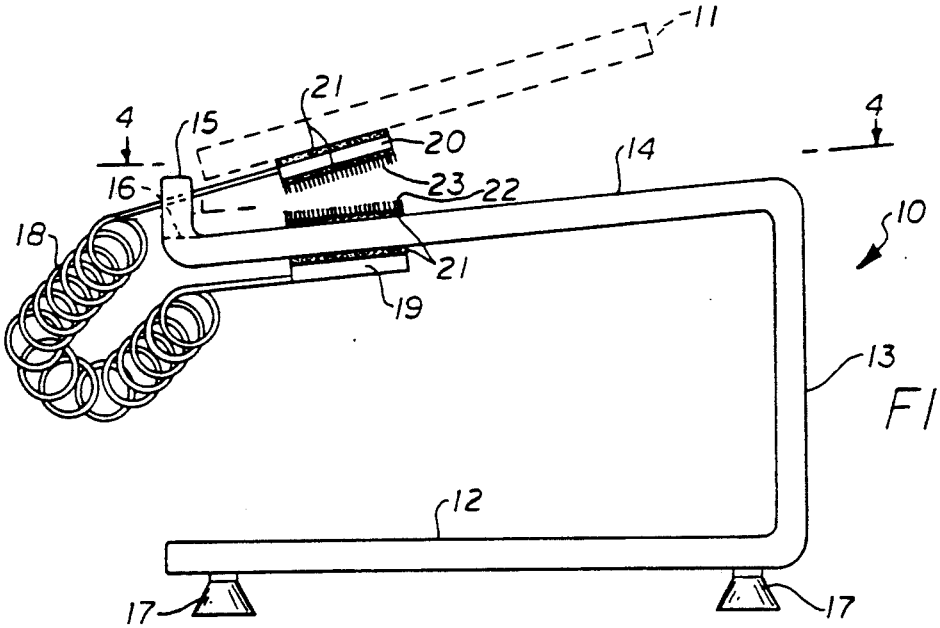
FIG. 3 is a side elevation of the support stand showing the tether cord connection.
Figure 5:
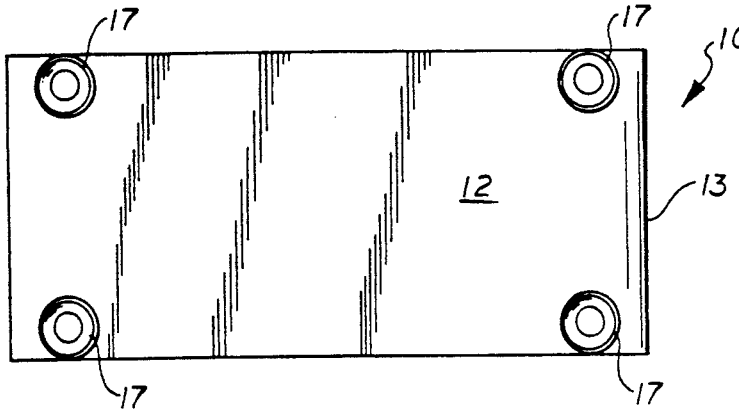
FIG. 5 is a bottom plan view of the support stand.

Referring to the drawings by numerals of reference, there is shown in FIGS. 1–5, a preferred support stand 10 for electronic remote control units 11.

The stand 10 has a rectangular horizontal bottom surface 12, a contiguous rectangular vertical end surface 13 extending upwardly from one end of the horizontal bottom surface, and a contiguous rectangular top surface 14 extending outward from the upper end of the vertical surface spaced directly above the horizontal bottom surface 12 at a slight angle downward relative to horizontal and terminating in a short vertical lip or wall 15 at the outer end. A vertical slot 16 is formed in the center of the wall 15.

In the preferred embodiment, suction cup members 17 are secured to the underside of the horizontal bottom surface 12 which allow the stand to be secured to a flat surface, such as the top of a coffee table or end table. The suction cups 17 when secured to the flat surface will reduce the likelihood of the stand being removed from the location in which it was intended to be used. However, it should be understood that small legs or pads may also be used in place of the suction cups.

An extendible tether cord 18 has a flat square or rectangular mounting element 19 at one end which is secured to the underside of the rectangular top surface 14 and another square or rectangular mounting element 20 at the opposed free end of the tether cord. The preferred tether cord 18 is a flexible elastomeric coiled cable, similar to a telephone handset cord, which can be pulled outwardly a distance from the stand, and will automatically recoil and occupy a small space when it is in the recoiled, or stored position.

The mounting element 19 is secured to the underside of the rectangular top surface 14 by a suitable glue or adhesive 21. The other mounting element 20 is secured to the underside of the electronic remote control unit 11 by a suitable glue or adhesive 21.

A square or rectangular strip of a fabric hook and loop fastener 22 is secured to the top side of the rectangular top surface 14, and a mating square or rectangular strip 23 of the fabric hook and loop fastener is secured to the outer surface of the mounting element 20 by a suitable glue or adhesive 21.

In the stored or non-use condition, the remote control unit 11 is releasably attached to the top side of the rectangular top surface 14 by the engagement of the mating hook and loop fastener strips 22 and 23, and the tether cord 18 is received in the slot 16 in the center of the wall 15. In use, the remote control unit 11 is lifted upwardly from the rectangular top surface 14 to disengage the mating hook and loop fastener strips 22 and 23. The remote control unit 11 can be pulled a distance outwardly from the stand 10 and aimed at the electronic entertainment device, and the tether cord 18 will expand as necessary, and will recoil as the remote control unit is replaced.

The suction cups 17 secured to the flat surface anchor the stand to the flat surface, making it easier to disengage the mating hook and loop fastener elements 22 and 23 between the stand and the remote control unit. Thus, the remote control unit 11 can be easily removed from the stand 10 with one hand. Since the remote control unit 11 is tethered to the stand, it cannot be completely separated therefrom and will not become lost or misplaced.

Because the stand 10 is secured by the suction cups 17 near the location of the electronic entertainment device, it also reduces the likelihood of the entire stand being removed from the location in which the remote control unit was intended to be used.

While this invention has been described fully and completely with special emphasis upon a preferred embodiment, it should be understood that within the scope of the appended claims the invention may be practiced otherwise than as specifically described herein.

I claim:

1. A stand for releasably holding an electronic remote control unit comprising in combination;

a generally rectangular stand member of unitary construction having a generally rectangular horizontal bottom surface and a flat rectangular top surface spaced above said horizontal bottom surface for supporting an electronic remote control unit thereon;

a flexible extendible and retractable tether cord secured at one end to said stand and having a free end adapted for connection to an electronic remote control unit to be supported on said stand, said cord is capable of being extended relative to said stand to allow removal of the electronic remote control unit from a position supported on said stand for use while preventing complete separation of the remote control unit from said stand, said cord is automatically retractable to occupy a small space in the retracted condition;

one element of a hook and loop fastener secured on said stand top surface and a mating element of the hook and loop fastener secured on the free end of said tether cord such that the electronic remote control unit connected to said tether cord free end is releasably engaged on said stand top surface in the supported position by engaging said hook and loop fasteners and removed therefrom by disengaging said hook and loop fasteners; and releasable attachment means on said stand bottom surface to releasably anchor said stand to a flat surface and facilitate one-handed disengagement of said hook and loop fasteners.

2. The stand according to claim 1 in which said tether cord is a length of spiral coiled flexible material.

3. The stand according to claim 1 in which;

said releasable attachment means on said bottom surface comprise suction cup members for releasably anchoring said stand on the flat surface and to facilitate one-handed disengagement of said engaged hook and loop fasteners when removing the electronic remote control unit from said stand.

4. The stand according to claim 1 in which said stand is a unitary configuration having a flat generally rectangular horizontal bottom surface, a contiguous flat rectangular vertical end surface extending upwardly from one end of said horizontal bottom surface, and a contiguous flat rectangular top surface extending outwardly from the upper end of said vertical surface spaced directly above said horizontal bottom surface for releasably supporting a remote control unit thereon.

5. The stand according to claim 4 in which said flat rectangular top surface extends outwardly and downwardly from the upper end of said vertical surface at a slight angle relative to said horizontal bottom surface and terminates in a short upstanding vertical wall at its outer end.

6. The stand according to claim 1 in which said tether cord has a first mounting element at one end secured to said stand by adhesive and a second mounting element secured at its free end, said second mounting element secured by adhesive to the electronic remote control unit to be supported on said stand, and said mating element of the hook and loop fastener secured on said second mounting element.

* * * * *